US006286590B1

(12) United States Patent
Park

(10) Patent No.: US 6,286,590 B1
(45) **Date of Patent: *Sep. 11, 2001**

(54) HEAT EXCHANGER WITH FLAT TUBES OF TWO COLUMNS

(75) Inventor: Jong-Jin Park, Seoul (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/833,430

(22) Filed: Apr. 7, 1997

(30) Foreign Application Priority Data

Apr. 9, 1996 (KR) ..... 96-10649

(51) Int. Cl.[7] ..... F28F 9/22; F28F 9/02

(52) U.S. Cl. ..... 165/174; 165/146; 165/153; 165/175; 165/176

(58) Field of Search ..... 165/153, 174, 165/175, 176, 146, 144, 151, 173

(56) References Cited

U.S. PATENT DOCUMENTS

| | | | | |
|---|---|---|---|---|
| 2,055,549 | * | 9/1936 | Modine | 165/146 |
| 2,488,627 | * | 11/1949 | Hisey | 165/153 X |
| 4,367,793 | * | 1/1983 | MacIntosh | 165/151 |
| 4,790,372 | * | 12/1988 | Gemeinhardt et al. | 165/173 |
| 4,958,681 | * | 9/1990 | Kadle | 165/151 |
| 4,977,956 | * | 12/1990 | Aoki et al. | 165/153 X |
| 5,168,925 | * | 12/1992 | Suzumura et al. | 165/176 |
| 5,174,373 | * | 12/1992 | Shinmura | 165/176 |
| 5,529,116 | * | 6/1996 | Sasaki et al. | 165/144 |
| 5,573,061 | * | 11/1996 | Chiba et al. | 165/176 |
| 5,582,239 | * | 12/1996 | Tsunoda et al. | 165/176 X |

FOREIGN PATENT DOCUMENTS

| | | | | |
|---|---|---|---|---|
| 725047 | * | 1/1996 | (CA) | 165/176 |
| 28855 | * | 12/1903 | (CH) | 165/151 |
| 69057 | * | 1/1914 | (CH) | 165/151 |
| 4305060 | * | 8/1994 | (DE) | 165/176 |
| 518224 | * | 12/1992 | (EP) | 165/176 |
| 130997 | * | 8/1983 | (JP) | 165/153 |
| 75892 | * | 3/1990 | (JP) | 165/153 |
| 4-148195 | * | 5/1992 | (JP) | 165/176 |

* cited by examiner

*Primary Examiner*—Leonard Leo
(74) *Attorney, Agent, or Firm*—Finnegan, Henderson, Farabow, Garrett & Dunner, L.L.P.

(57) ABSTRACT

Disclosed is a heat exchanger with flat tubes of two columns, including: a first header having a plurality of connecting grooves formed at a zigzag arrangement of two columns; a second header having a plurality of connecting grooves formed at the corresponding positions of the first header; and a plurality of flat tubes coupled to the plurality of connecting grooves of the first and second headers, for transferring refrigerant, wherein a first flat tubes at a first column are placed at fluid inlet side of air, and a second flat tubes at a second column are placed at ejecting outlet side of the air.

6 Claims, 2 Drawing Sheets

HEAT EXCHANGER WITH FLAT TUBES OF TWO COLUMNS

BACKGROUND OF THE INVENTION

1. Field of the Invention

The present invention generally relates to a heat exchanger, and more particularly to an improved heat exchanger with flat tubes of two columns for enchancing operational efficiency by improving structure and sectional shape of the flat tube.

2. Description of the Related Art

FIGS. 1A to 1C are schematic diagrams of a conventional condensor, wherein FIG. 1A is a top view, FIG. 1B is a front view, and FIG. 1C is a right-sided view, respectively.

Referring to FIGS. 1A to 1C, the conventional includes a first header 4 having an fluid inlet 1 where a refrigerant gas is introduced, an outlet 2 where condensing liquid is drawn off, and a diaphragm 3 established therein, a second header 6 corresponding to the first header 4, a plurality of flat tubes 5 coupled between the first header 4 and second header 6, for transferring the refrigerant gas each other, the plurality of flat tubes being coupled to holes of the first header 4 and second header 6 spaced apart at predetermined intervals, and a fold plate 7 established between two adjacent flat tubes, for easily exchanging heat with exterior air.

In cooling operation of the above-mentioned condenser, the refrigerant is introduced into the first header 4 from the fluid inlet 1, and is then transferred to a flat tube 5' at the highest place among the plurality of flat tubes 5 by means of the diaphragm 3*a*. The refrigerant moves to the second header 6 via the flat tube 5'. The moved refrigerant returns to the first header 4 via a second flat tube 5" being right below the flat tub 5' by means of a diaphragm 3*b* of the second header 6.

Through the above-mentioned periodic circulation of the refrigerant, heat exchange is performed, whereby condensing liquid is drawn off the outlet 2 established below the first header 6.

In the conventional condensor performing heat exchange by the above-mentioned circulation procedure, while the refrigerant exchanges heat by the air flow, heat transfer with the exterior air is actively performed at the fluid inlet portion A but heat transfer is not actively performed at the outlet portion B, to thereby show a low heat transfer efficiency. The reason is that the outlet portion B has an smaller exposed area than the inlet portion A.

SUMMARY OF THE INVENTION

Accordingly, it is an object of this invention to provide an improved heat exchanger with flat tubes of two columns for enchancing operational efficiency by improving structure and sectional shape of the flat tube.

According to the present invention, a heat exchanger with flat tubes of two columns, includes a first header having a plurality of connecting grooves formed at a zigzag arrangement of two columns; a second header having a plurality of connecting grooves formed at the corresponding positions of the first header; and a plurality of flat tubes coupled to the plurality of connecting grooves of the first and second headers, for transferring a refrigerant, wherein a first flat tubes at a first column are placed at fluid inlet side of air, and a second flat tubes at a second column are placed at outlet side of the air.

BRIEF DESCRIPTION OF THE DRAWINGS

Further objects and advantages of the present invention will be apparent from the following description, reference being had to the accompanying drawings wherein preferred embodiment of the present invention is clearly shown.

In the drawings.

DETAILED DESCRIPTION OF THE INVENTION

Hereinbelow, one specific embodiment of the present invention will be described with reference to enclosed drawings.

Figure 1A:
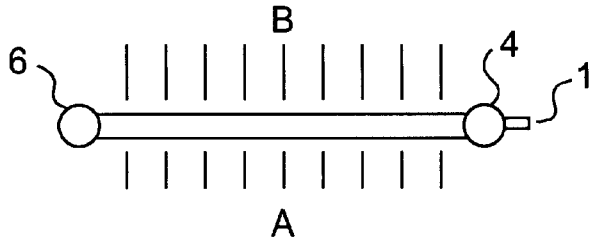
FIG. 1a (PRIOR ART)
FIGS. 1A to 1C are schematic diagrams of a conventional heat exchanger, FIG. 1A being a top view, FIG. 1B a front view, and FIG. 1C a right-sided view, respectively.
Figure 1B:
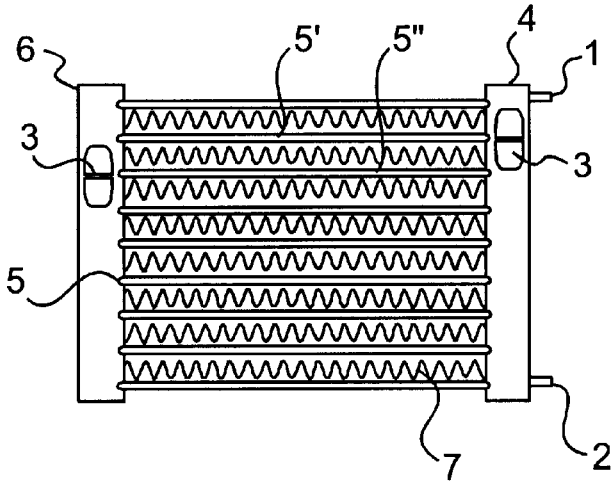
FIG.1 b (PRIOR ART)
Figure 1C:
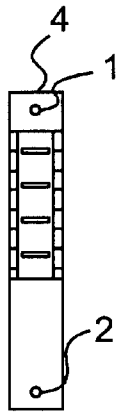
FIG.1 c (PRIOR ART)
Figure 2A:
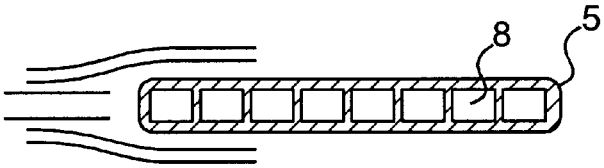
FIG. 2a (PRIOR ART)
FIG. 2 is a sectional view of a flat tube of FIG. 1B.
Figure 3A:
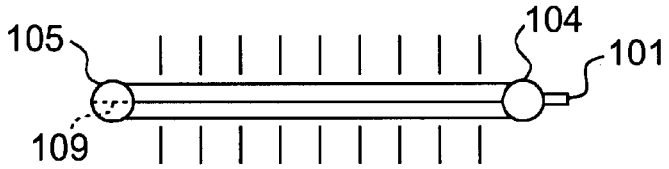
FIGS. 3A to 3C are schematic diagrams of a heat exchanger according to the present invention, FIG. 3A being a top view, FIG. 3B a front view, and FIG. 3C a right-sided view, respectively.
Figure 3B:
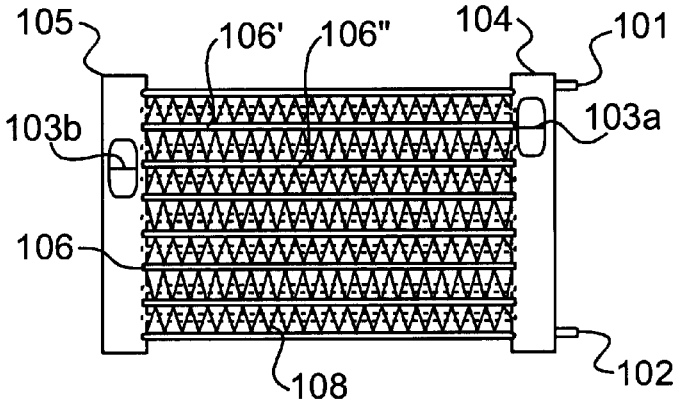
Figure 3C:
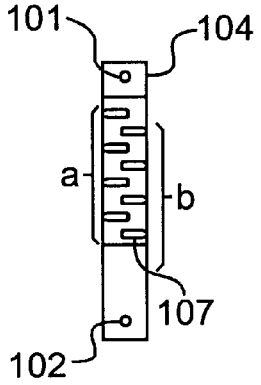
Figure 4:
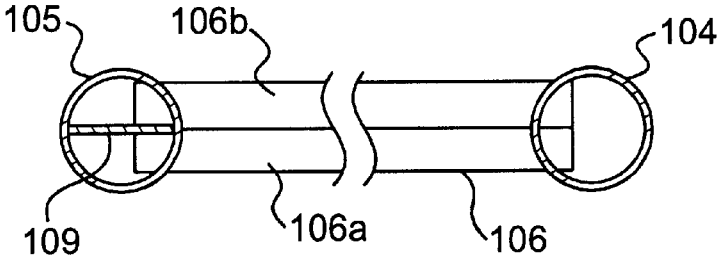
FIG. 4 is a sectional view of the first and second header of FIG. 3B.

FIGS. 3A to 3C are schematic diagrams of a heat exchanger according to the present invention, wherein FIG. 3A is a top view, FIG. 3B is a front view, and FIG. 3C is a right-sided view, respectively.

Referring to FIGS. 3A to 3C, a heat exchanger with flat tubes of two columns, includes a first header 104 and a second header 105, each of which have a plurality of connecting grooves 107 to couple a plurality of flat tube 106 to the plurality of connecting grooves 107, respectively spaced apart at predetermined intervals at a zigzag arrangement. The plurality of connecting grooves 107 are formed at two column arrangements such that the corresponding plurality of flat tubes 106 are coupled to the first and second headers 104 and 105 at two parallel columns. A fold plate 108 is established between two adjacent flat tubes 106, for easily exchanging heat with exterior air. A dividing diaphragm 109 is also provided at the second header 105, in order to move a refrigerant into respective flat tubes at divided state of two column. Non-descriptive reference numeral 102 in the drawings, is a outlet.

In cooling operation of the above-mentioned condensor, the refrigerant is introduced into the first header 104 from the fluid inlet 101, and is then transferred to a flat tube 106' positioned at the highest place among the plurality of flat tubes 106 by means of a diaphragm 103*a*. The refrigerant moves to the second header 105 via the flat tube 106'. The moved refrigerant is divided into two transfer paths by a diaphragm 103*b* and the dividing diaphragm 109, both of them being formed at the second header 105, and is introduced into a first column flat tube 106*a* and a second column flat tube 106*b*, and returns to the first header 104. Through the above-mentioned periodic circulation of the refrigerant, heat exchange is performed, whereby condensing liquid is drawn off the outlet 102 established below the first header 104.

The condenser performing heat exchange by the above-mentioned circulation procedure, shows an improved heat exchange effect at the same air flow condition with the conventional art because the plurality of flat tubes 106 at zigzag arrangement has much front side areas where heat exchange is actively performed due to collision of the generated air flow.

Figure 5A:
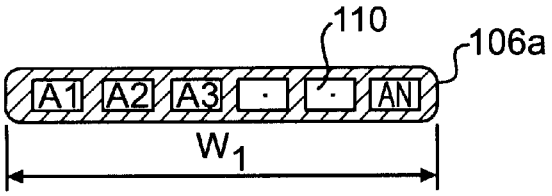
FIG. 5A is a sectional view of a flat tube coupled to the first column of the first and second headers.
Figure 5B:
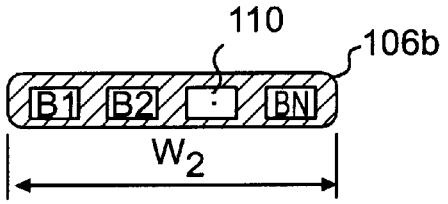
FIG. 5B is a sectional view of a flat tube coupled to the second column of the first and second headers.

In addition, the flat tube 106*b* of the second column has a low heat exchange capability compared with the flat tube 106*a* of the first column because of its bad positioned condition. In order to compensate this bad positioned condition, first and second flat tubes 106*a* and 106*b* having a different width and hole number from each other are applied to the condenser of the present invention. In other words, a width W2 of the second flat tube 106*b* is smaller than a width W1 of the first flat tube 106*a*, and a hole number of the second flat tube 106*b* is also smaller than that of the first flat tube 106*a* as shown in FIGS. 5A and 5B. Through the above-mentioned structure alteration, optimum condition in width and hole number of the first and second flat tubes are determined, to thereby enhance efficiency in heat exchange to the hight degree.

In addition, the present heat exchanger can decrease the volume of the condenser in comparision with the conventional condenser under identical cooling condition, and the decrease in volume makes the installation of the heat exchanger to be easily.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A heat exchanger with two columns of flat tubes, comprising:

a first header having a plurality of first connecting grooves formed in a zigzag arrangement of two columns;

a second header having a plurality of second connecting grooves formed in a zigzag arrangement of two columns corresponding to the arrangement of the first connecting grooves in the first header;

a plurality of first flat tubes for transferring heat transfer fluid, each of the first flat tubes including a first end connected to one of the first connecting grooves in the first header and a second end connected to one of the second connecting grooves in the second header so that a column of the first flat tubes are at an air inlet side of the heat exchanger;

a plurality of second flat tubes for transferring heat transfer fluid, each of the second flat tubes including a first end connected to one of the first connecting grooves in the first header and a second end connected to one of the second connecting grooves in the second header so that a column of the second flat tubes are at an air outlet side of the heat exchanger;

a dividing diaphragm arranged in the second header to define first and second separate flow paths extending along the length of the second header, the first flow path being in flow communication with one of the first flat tubes and the second flow path being in flow communication with one of the second flat tubes; and plurality of flow alternating diaphragms arranged in the first and second headers such that the flow alternating diaphragms block passage of heat transfer fluid along the length of the first and second headers to provide alternating direction of heat transfer fluid flow in the first and second flat tubes.

2. The heat exchanger of claim 1, wherein the plurality of flow alternating diaphragms include a first diaphragm in the first header and a second diaphragm in the second header, the first diaphragm being arranged in the first header to cause flow of heat transfer fluid from the first header to the second header via a first pair of the first and second flat tubes and the second diaphragm being arranged in the second header to cause flow from the second header to the first header via a second pair of the first and second flat tubes.

3. A heat exchanger with two columns of flat tubes, comprising:

a first header having a plurality of first connecting grooves formed in a zigzag arrangement of two columns;

a second header having a plurality of second connecting grooves formed in a zigzag arrangement of two columns corresponding to the arrangement of the first connecting grooves in the first header;

a plurality of first flat tubes each including a plurality of passages for transferring heat transfer fluid, a first end connected to one of the first connecting grooves in the first header and a second end connected to one of the second connecting grooves in the second header so that a column of the first flat tubes are at an air inlet side of the heat exchanger;

a plurality of second flat tubes each including a plurality of passages for transferring heat transfer fluid, a first end connected to one of the first connecting grooves in the first header and a second end connected to one of the second connecting grooves in the second header so that a column of the second flat tubes are at an air outlet side of the heat exchanger, said second flat tubes having a width smaller than that of said first flat tubes; and a plurality of flow alternating diaphragms arranged in the first and second headers such that the flow alternating diaphragms block passage of heat transfer fluid along the length of the first and second headers to provide alternating direction of heat transfer fluid flow in the first and second flat tubes, wherein said second header has a dividing diaphragm for supplying the heat transfer fluid into said first flat tubes and said second flat tubes, wherein the dividing diaphragm is arranged in the second header to define first and second separate flow paths extending along the length of the second header, the first flow path being in flow communication with one of the first flat tubes and the second flow path being in flow communication with one of the second flat tubes.

4. The heat exchanger of claim 3, wherein the plurality of flow alternating diaphragms include a first diaphragm in the first header and a second diaphragm in the second header, the first diaphragm being arranged in the first header to cause flow of heat transfer fluid from the first header to the second header via a first pair of the first and second flat tubes and the second diaphragm being arranged in the second header to cause flow from the second header to the first header via a second pair of the first and second flat tubes.

5. A heat exchanger with two columns of flat tubes, comprising:

a first header having a plurality of first connecting grooves formed in a zigzag arrangement of two columns;

a second header having a plurality of second connecting grooves formed in a zigzag arrangement of two columns corresponding to the arrangement of the first connecting grooves in the first header;

a plurality of first flat tubes each including a plurality of passages for transferring heat transfer fluid, a first end connected to one of the first connecting grooves in the first header and a second end connected to one of the second connecting grooves in the second header so that a column of the first flat tubes are at an air inlet side of the heat exchanger;

a plurality of second flat tubes each including a plurality of passages for transferring heat transfer fluid, a first end connected to one of the first connecting grooves in the first header and a second end connected to one of the second connecting grooves in the second header so that a column of the second flat tubes arm at an air outlet side of the heat exchanger, said second flat tubes having fewer passages than said first flat tubes; and a plurality of flow alternating diaphragms arranged in the first and second headers such that the flow alternating diaphragms block passage of heat transfer fluid along the length of the first and second headers to provide alternating direction of heat transfer fluid flow in the first and second flat tubes, wherein said second header has a dividing diaphragm for supplying the heat transfer fluid into said first flat tubes and said second flat tubes, wherein the dividing diaphragm is arranged in the second header to define first and second separate flow paths extending along the length of the second header, the first flow path being in flow communication with one of the first flat tubes and the second flow path being in flow communication with one of the second flat tubes.

6. The heat exchanger of claim 5, wherein the plurality of flow alternating diaphragms include a first diaphragm in the first header and a second diaphragm in the second header, the first diaphragm being arranged in the first header to cause flow of heat transfer fluid from the first header to the second header via a first pair of the first and second flat tubes and the second diaphragm being arranged in the second header to cause flow from the second header to the first header via a second pair of the first and second flat tubes.

* * * * *